United States Patent [19]

Steiner

[11] 4,082,445

[45] Apr. 4, 1978

[54] TONER CONTROL SYSTEM FOR AN ELECTROSTATIC REPRODUCTION MACHINE

[75] Inventor: Edward L. Steiner, Macedon, N.Y.

[73] Assignee: Xerox Corporation, Stamford, Conn.

[21] Appl. No.: 729,334

[22] Filed: Oct. 4, 1976

Related U.S. Application Data

[63] Continuation of Ser. No. 634,018, Nov. 21, 1975, abandoned.

[51] Int. Cl.[2] ..... G03G 15/00

[52] U.S. Cl. ..... 355/14; 118/646; 355/3 DD

[58] Field of Search ..... 355/3 DD, 14; 118/7, 118/9, 637, 621, 646; 222/57, DIG. 1

[56] References Cited

U.S. PATENT DOCUMENTS

| | | | |
|---|---|---|---|
| 3,348,522 | 10/1967 | Donohue | 118/9 X |
| 3,674,353 | 7/1972 | Trachtenberg | 355/3 DD |
| 3,911,861 | 10/1975 | Griesmer | 118/7 |
| 3,924,462 | 12/1975 | Bock | 118/646 X |

OTHER PUBLICATIONS

"Toner Feed Control System," IBM Technical Disclosure Bulletin; Sept. 1972, pp. 1258–1259.

*Primary Examiner*—William M. Shoop
*Attorney, Agent, or Firm*—Earl T. Reichert

[57] ABSTRACT

An electrostatic reproduction machine has an improved control system therein for controlling the operation of a toner dispenser. The system which includes a light source and a light sensitive device, compares the difference between the amount of light reflected from an undeveloped area of a photoreceptor and the amount reflected from a developed test image to a reference value and actuates the toner dispenser if the density of the test image is not up to a desired value. To compensate for any toner accumulation on either the light source or the light sensitive device, the signal output of the light sensitive device is compared to a reference value and an appropriate error signal is generated and applied to the light source.

5 Claims, 2 Drawing Figures

TONER CONTROL SYSTEM FOR AN ELECTROSTATIC REPRODUCTION MACHINE

This is a continuation of application Ser. No. 634,018, filed Nov. 11, 1975, now abandoned.

BACKGROUND OF THE INVENTION

The present invention relates to an improved developing apparatus, but more particularly to improved means for the automatic control of a toner dispenser to maintain a constant image density on a photoreceptor of an electrostatic reproduction machine during operation of the latter.

In conventional xerography, a xerographic plate or photoreceptor comprising a layer of photosensitive insulating material affixed to a conductive backing is used to support electrostatic latent images. In the xerographic process, the photosensitive surface is electrostatically charged, and the charged surface is then exposed to a light pattern of the image being reproduced to thereby discharge the surface in the areas wherein light strikes the surface. The undischarged areas of the surface thus form an electrostatic charge pattern (an electrostatic latent image) conforming to the original pattern. The latent image is then developed by contacting it with a finely divided electrostatically attractable powder referred to as "toner". Toner is held on the image areas by the electrostatic charge on the surface. Where the charge is greater, a greater amount of toner is deposited. Thus, a toner image is produced in conformity with a light image of the copy being reproduced. Generally, the developed image is then transferred to a suitable transfer member (e.g., paper), and the image is affixed thereto to form a permanent record of the original document.

In the practice of xerography, the transfer member is caused to move in synchronized contact with the photosensitive surface during the transfer operation, and an electrical potential opposite from the polarity of the toner is applied to the side of the paper remote from the photosensitive surface to electrostatically attract the toner image from the surface to the paper.

Heretofore, it has been common to require an operator of an electrostatic reproduction machine to observe the quality of copies produced, and to replenish the toner when the legibility or density of a developed image drops below a subjective acceptable level. Although such a toner replenishment system is satisfactory for many applications, such a system is highly unsatisfactory for a modern high-speed electrostatic reproduction machine. Although more sophisticated toner replenishment systems have been proposed, these are unsatisfactory for a number of reasons. Generally, conventional automatic toner control systems sense the concentration of the toner within the developer housing itself and this arrangement does not provide the accurate control necessary for modern high-speed electrostatic reproduction machines. Also, many of these conventional systems have proven unreliable over extended periods of use, and insensitive to slight variations in toner concentration of a magnitude adversely affecting copy quality.

SUMMARY OF THE INVENTION

It is a primary object of the present invention to overcome the above problems of prior art arrangements. To effect this, light of a constant known intensity is emitted toward a photoreceptor during the operation of an electrostatic reproduction machine. The photoreceptor contains a clean portion and a portion contained a developed test stripe. The difference between the light reflected from both portions is compared to a given desired value via a circuit, and if the density of the test stripe as indicated by this difference is not up to the desired value, a signal is generated by the circuit to increase the density of the strip either by adding more toner to the developer housing, or if desired, by adjusting the electrical bias on the magnetic brushes if the latter are used. Any parameter that effects the toner density on the photoreceptor can be controlled with the present control system.

DETAILED DESCRIPTION OF THE INVENTION

Figure 1:
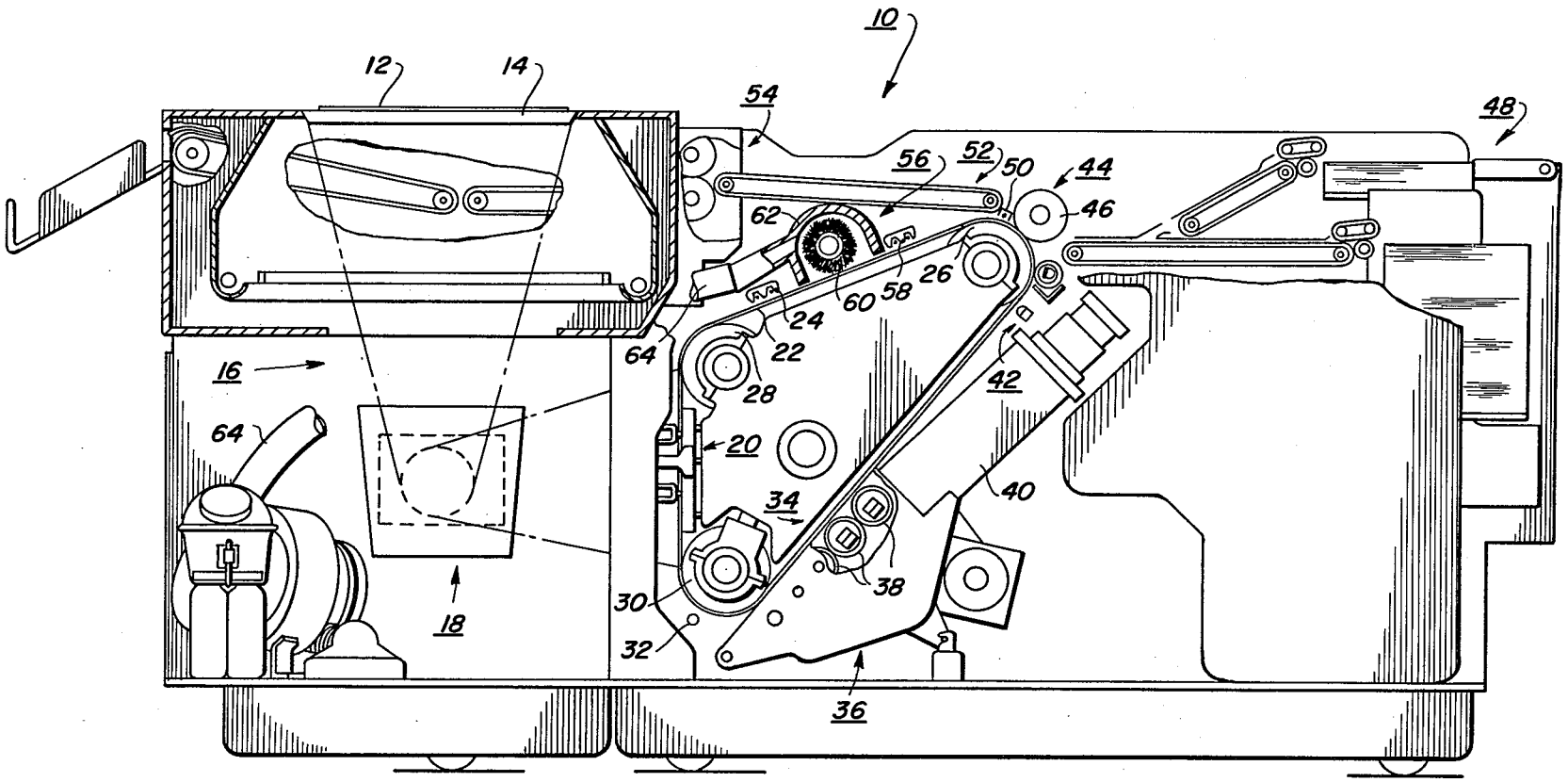
FIG. 1 is a schematic sectional view of an electrostatic reproduction machine embodying the present invention.

For a general understanding of an electrostatic reproduction machine in which the present invention may be incorporated, reference is made to FIG. 1. As in all electrostatic reproduction machines of the type illustrated, a light image of an original is projected onto the photosensitive surface of a xerographic plate to form an electrostatic latent image thereon. Thereafter, the latent image is developed with developing material comprising carrier beads and toner particles triboelectrically adhering thereto to form a xerographic powder image corresponding to the latent image on the photosensitive surface. The powder image is then electrostatically transferred to a transfer member such as a sheet of paper to which it may be fixed by a fusing device whereby the toner image is caused permanently to adhere to the transfer member.

In the illustrated machine 10, an original 12 to be copied is placed upon a transparent support plate 14 fixedly arranged in an illumination assembly indicated generally by the reference numeral 16. While upon the platen, the illumination assembly flashes light rays upon the original, thereby producing image rays corresponding to the informational areas on the original. The image rays are projected by means of an optical system 18 to an exposure station 20 for exposing the surface of a moving xerographic plate in the form of a flexible photoconductive belt or photoreceptor 22. In moving in the direction indicated by the arrow, prior to reaching the exposure station 20, that portion of the belt being exposed would have been uniformly charged to approximately +900 volts by a corona generating device 24 located at a belt run extending between the belt supporting rollers 26 and 28. The exposure station extends between the roller 28 and a third roller 30.

The exposure of the photosensitive surface of the belt to the light image discharges the surface in the areas struck by light whereby an electrostatic latent image remains on the belt in image configuration corresponding to the light image projected from the original on the support platen. As the belt continues its movement, the latent image passes a pitch fade-out lamp 32, and through a developing station 34 where a developing apparatus indicated generally by the reference numeral 36 is positioned. The operation of the pitch fade-out lamp 32 as an element of the present invention will be more fully explained below. The developing apparatus 36 comprises a plurality of magnetic brushes 38 which carry developing material to the surface of the upwardly moving belt 22. The magnetic brushes 38 are electrically biased by any suitable means such as that disclosed in U.S. Pat. application Ser. No. 440,880 filed Feb. 8, 1974, the disclosure of the latter being incorporated by reference herein to the extent necessary. As the developing material is applied to the belt, toner particles in the development material are electrostatically attracted to the charged photosensitive surface to form a powder image (an electrostatic developed image), the polarity of the toner particles being opposite to that of the photosensitive surface. Toner is periodically and automatically dispensed into the developing apparatus 36 by a toner dispenser 40 in a manner to be described hereinafter, the toner dispenser being a conventional foam roller type dispenser as described in U.S. Pat. No. 3,724,422, the disclosure of the latter being incorporated by reference herein to the extent necessary.

The developed electrostatic image is transported by the belt 22 past sensing station 42 to a transfer station 44 where a sheet of paper is moved at a speed in synchronism with the moving belt in order to effect transfer of the developed image to the paper. The sensing station 42 includes a light emitting diode (LED) and a phototransistor, and the operation of the LED and phototransistor as elements of the present invention will be more fully explained below. Located at the transfer station 44 is a transfer roll 46 which is arranged on the frame of the machine to contact the back side of a sheet of paper as the latter is moved or fed between the belt and the transfer roll. The transfer roll 46 is electrically biased with sufficient voltage so that the developed image on the belt may be electrostatically attracted to the adjacent side of a sheet of paper as the latter is brought into contact therewith. The transfer roll 46 applies a charge to the entire sheet as it moves between the roll and the belt 22.

A suitable sheet transport mechanism transports sheets of paper seriatim from a paper handling mechanism indicated generally by the reference numeral 48 to the developed image on the belt as the same is carried around the roller 26.

As a sheet emerges from the transfer station 44, a charge is deposited thereon by a detack corona generating device 50 to lessen the electrostatic attraction between the photoreceptor 22 and the sheet so that the latter can be removed by a vacuum stripping and transport mechanism 52. The sheet is thereafter retained on the underside of the vacuum stripping and transport mechanism 52 for movement into a fuser assembly indicated generally by the reference numeral 54 wherein the powder image on the sheet is permanently affixed thereto. After fusing, the finished copy is discharged at a suitable point for collection. The toner particles remaining as residue on the photoreceptor 22 are carried by the belt to a cleaning apparatus 56. The cleaning apparatus 56 comprises a corona discharge device 58 for neutralizing charges remaining on the untransferred toner particles, a rotating brush 60 mounted within a housing 62, and a vacuum outlet 64.

Figure 2:
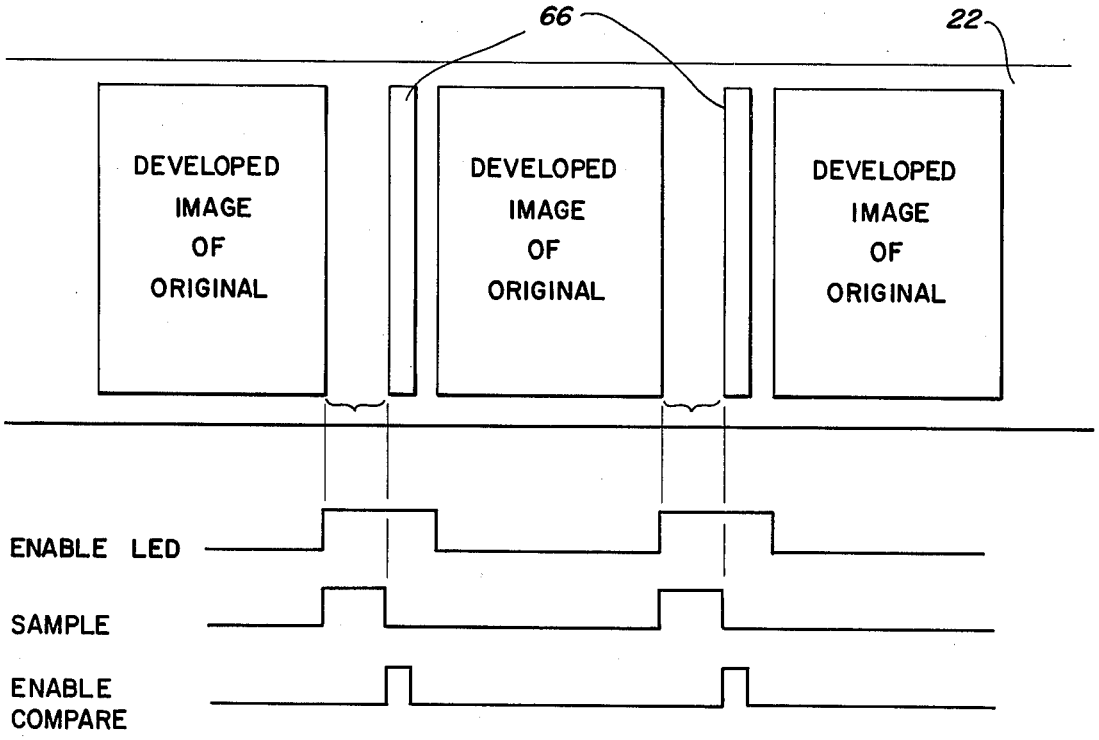
FIG. 2 shows the photoreceptor with developed images of an original document thereon, and developed test stripes between the developed images.
Figure 3:
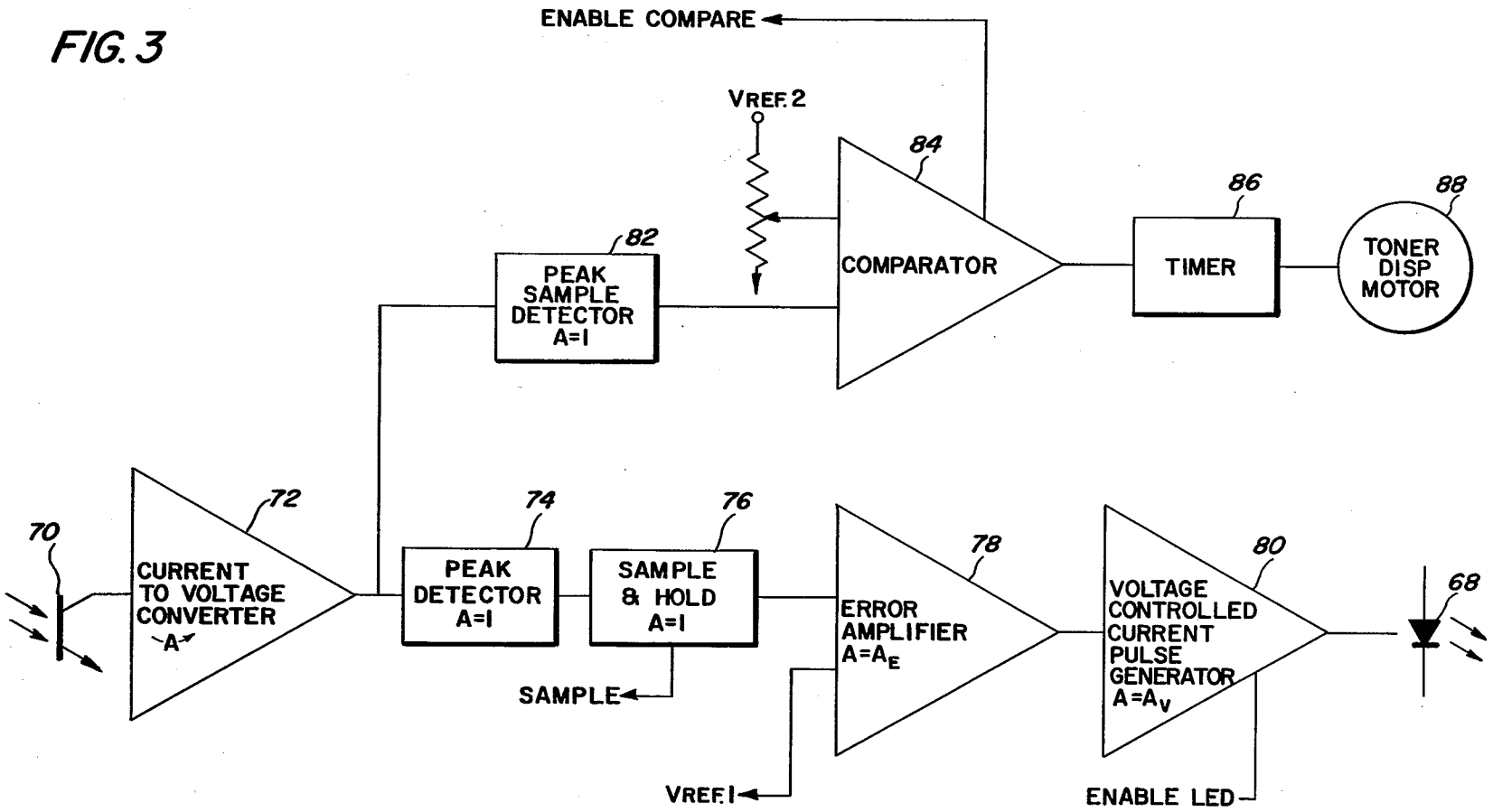
FIG. 3 is an electrical schematic view of the control system of the present invention.

Referring to FIGS. 2 and 3, the operation of the present invention will now be described in more detail. As the photoreceptor 22 moves around the rollers on which it is mounted, the pitch fade-out lamp 32 is normally flashed on between the latent images of the original to discharge a portion of the uniformly charged selenium surface between latent images of the original so that that portion will not be developed as it passes the developing apparatus 34. For a more detailed explanation of this operation, U.S. Patent application, Ser. No. 445,013 filed in the U.S. Patent Office on Feb. 22, 1974, and now abandoned, is incorporated by reference herein to the extent necessary. For purposes of the present invention, however, the fadeout lamp is also blinked off briefly between latent images. By blinking off the fade-out lamp briefly during this interval between latent images of the original, a latent test image in the form of a test stripe is produced between each latent image of the original. As the photoreceptor 22 moves past the developing apparatus, test stripes 66 are produced as shown in FIG. 2. As the photoreceptor 22 moves past the sensing station 42, a light source in the form of an LED 68 directs a constant known intensity of light toward the undeveloped portion of the photoreceptor which lies between a latent image and a test stripe, which light is reflected back into a light sensitive device or apparatus in the form of a phototransistor 70. As can be seen in FIG. 3, a closed loop is formed by the phototransistor 70, current to voltage converter 72, peak detector 74, sample and hold section 76, error amplifier 78, voltage controlled current pulse generator 80, and the LED 68. This closed loop compensates for any circuit variations, and also any variations resulting from toner accumulations on the LED 68 and phototransistor 70. The clean portion of the photoreceptor is thus scanned by the LED 68 and phototransistor 70 to stabilize the loop, after which the latter is placed into a hold mode to keep the light output from the LED 68 constant. When a test stripe 66 now moves past the LED 68 and phototransistor 70, the difference between the amount of light reflected off the stripe and that reflected off the clean portion of the photoreceptor is compared to a reference value by peak sample detector 82 and comparator 84, and if the test stripe is not sufficiently developed, a timer 86 is actuated to drive a motor 88 which rotates a foam roll dispenser to dispense toner into the developing apparatus 36, the timer serving to actuate the motor for a predetermined time, e.g., 0.5 seconds; the current to voltage converter 72 is still active while light is being reflected from the test stripe 66. This procedure continues until the test stripe is sufficiently developed, after which the timer 86 will not be actuated by comparator 76. Thus, each test stripe continues to get darker until the desired value is reached.

In the circuit illustrated in FIG. 3, the phototransistor 70 is biased by the current to voltage converter 72, the latter transforming the current pulses in the phototransistor to voltage pulses. The voltage pulses are proportional to the intensity of light reflected onto the phototransistor. The peak detector 70 samples the magnitude of the peak output voltage from the current to voltage converter 72, and transforms the peak value to a constant DC level of the same magnitude as the peak value. The sample and hold section 76 monitors the output of the peak detector 74 and can store and hold that instantaneous value at its output for a short time. Voltage controlled current pulse generator 80 linearly transforms a voltage input from error amplifier 78 into current pulses, the current pulses being applied to the LED 68.

Assuming that the sample and hold section 76 is in the sample mode, the closed loop system illustrated can be made to operate in the active range (error amplifier 78 not saturated) by adjusting the gain of the current to voltage converter 72. Assuming that the phototransistor 70 is exposed to a clean portion of the photoreceptor 22, the output of the sample and hold section 76 is equal to the $V_{REF}$ of the error amplifier 78 if the gain of the error amplifier is much greater than one. If the output of the sample and hold section 76 is equal to $V_{REF}$, the peak amplitude being fed to the input of the peak sample detector 82 is equal to $V_{REF}$ and is constant for all active closed loop conditions when the sample and hold section is in the sample mode. Thus, with the present invention, a clean portion of the photoreceptor is sampled and held before a developed test stripe is sampled. The density of the developed test stripe is then determined by comparing the peak voltage output of the current to voltage converter 72 generated by sensing the clean portion with the same peak voltage output of the current to voltage converter 72 generated by sensing the developed test stripe.

While the invention has been described with reference to the structure disclosed, it is not confined to the details set forth, but is intended to cover such modifications or changes as may come within the scope of the following claims.

What is claimed is:

1. In an electrostatic reproduction machine having a developing apparatus for applying toner to an electrostatic latent image of an original on a photoreceptor to develop the latent image, means for replenishing toner in the developing apparatus to compensate for toner depletion resulting from the development of a plurality of latent images, and means for producing a developed test image on the photoreceptor, an improved control system for controlling the operation of the replenishing means by comparing the difference between the amount of light reflected from an undeveloped area of the photoreceptor and the amount reflected from the developed test image to a reference value, the control system comprising:

a sensing station having a light source and a light sensitive device, means including the light source for sequentially directing light toward the undeveloped area of the photoreceptor and the test image, means including the light sensitive device for sequentially measuring the amount of light reflected from the undeveloped area and from the test image, means for generating a first signal which is proportional to the amount of light reflected from the undeveloped area, means for generating a second signal which is proportional to the amount of light reflected from the test image, means for measuring the difference between the first and second signals and for comparing the difference to a reference value and for generating a third signal if the difference indicates that the density of the test image does not correspond to the desired density represented by the reference value, and means including error detecting means for compensating for any toner accumulation on the sensing station by generating an error signal.

2. The invention set forth in claim 1, wherein the error detecting means includes means for comparing the output of the light sensitive device to a reference value.

3. The invention set forth in claim 2, wherein the error detecting means includes an error amplifier.

4. The invention set forth in claim 2, including means for applying the error signal output of the error detecting means to the light source.

5. The invention set forth in claim 2, including timing means responsive to the third signal for actuating the replenishing means to said toner to the developing apparatus.

* * * * *